United States Patent [19]

Cloud, Sr.

[11] 4,022,506

[45] May 10, 1977

[54] ZIPPER OPERATOR

[76] Inventor: James R. Cloud, Sr., P.O. Box 339, Barnesville, Ga. 30204

[22] Filed: Feb. 27, 1976

[21] Appl. No.: 662,000

[52] U.S. Cl. ..... 294/1 A; 24/205.15 H
[51] Int. Cl.[2] ..... A44B 19/00
[58] Field of Search ..... 294/1 R, 1 A, 19 R; 24/205.15 H

[56] References Cited

UNITED STATES PATENTS

| | | | |
|---|---|---|---|
| 3,059,301 | 10/1962 | Dierks | 294/1 A X |
| 3,122,809 | 3/1964 | Shee | 24/205.15 H |
| 3,249,977 | 5/1966 | Cloud | 24/205.15 H |
| 3,354,520 | 11/1967 | Morgen | 294/19 R X |
| 3,836,189 | 9/1974 | Borelli | 294/1 A |

FOREIGN PATENTS OR APPLICATIONS

| | | | |
|---|---|---|---|
| 829,392 | 3/1960 | United Kingdom | 24/205.15 H |

*Primary Examiner*—Johnny D. Cherry
*Attorney, Agent, or Firm*—Berman, Aisenberg & Platt

[57] ABSTRACT

A zipper closure operator for opening and closing zipper closures located at the backs of garments. A zipper actuating member is attached to a string which may be grasped by the user. The actuating member has an inclined slot to receive and hold the zipper operating tab. The actuating member also has a triangular lug engageable between the teeth of the zipper to act as a guard to prevent the fabric of the garment from becoming enmeshed with the zipper teeth when the zipper is being closed by upward movement of the actuating member. The slot has a cross sectional shape adapted to receive an irregularly contoured zipper operating tab.

7 Claims, 10 Drawing Figures

11
12
13
14
15
16
17
18
19
20
21
22
23
24
25
26
5
8
10

ZIPPER OPERATOR

This invention relates to a zipper closure operator, and more particularly to a zipper closure operator especially adapted for opening and closing zipper closures located at the back of garments.

A main object of the invention is to provide a novel and improved zipper closure operator for opening and closing zipper closures located at the backs of garments, the operator being very simple in construction, being easy to use, being reliable in operation, and overcoming the difficulty heretofore encountered in opening and closing zipper closures located at the backs of garments wherein the user must reach over her shoulder or reach rearwardly behind her back to grasp the zipper operating tab, and frequently requiring the assistance of another person for such operation.

A further object of the invention is to provide an improved zipper closure operator which may be used without requiring excessive exertion on the part of the user and which is provided with means to prevent adjacent fabrics from being caught between the teeth of the associated zipper while the zipper is being closed.

A still further object of the invention is to provide an improved zipper closure operating device which can be employed effectively either to close a zipper located at the back of a garment or to open such a zipper, the device involving very inexpensive components, being variable in construction, being easy to attach to the operating tab of a zipper, and conforming in shape with various zipper tabs of irregular contour.

A still further object of the invention is to provide an improved zipper closure operator especially adapted for use in opening and closing zipper closures located at the backs of garments, the device having means for automatically interlocking with the operating tab of a zipper to enable the zipper to be easily opened or closed without undue exertion on the part of the user, and being also arranged so that an adjacent undergarment or fabric from the garment containing the zipper will not be caught between the teeth of the zipper when the zipper is being closed.

Further objects and advantages of the invention will become apparent from the following description and claims, and from the accompanying drawings, wherein:

Figures 1, 2, 3, 4, 5, 6, 7, 8, 9, 10:
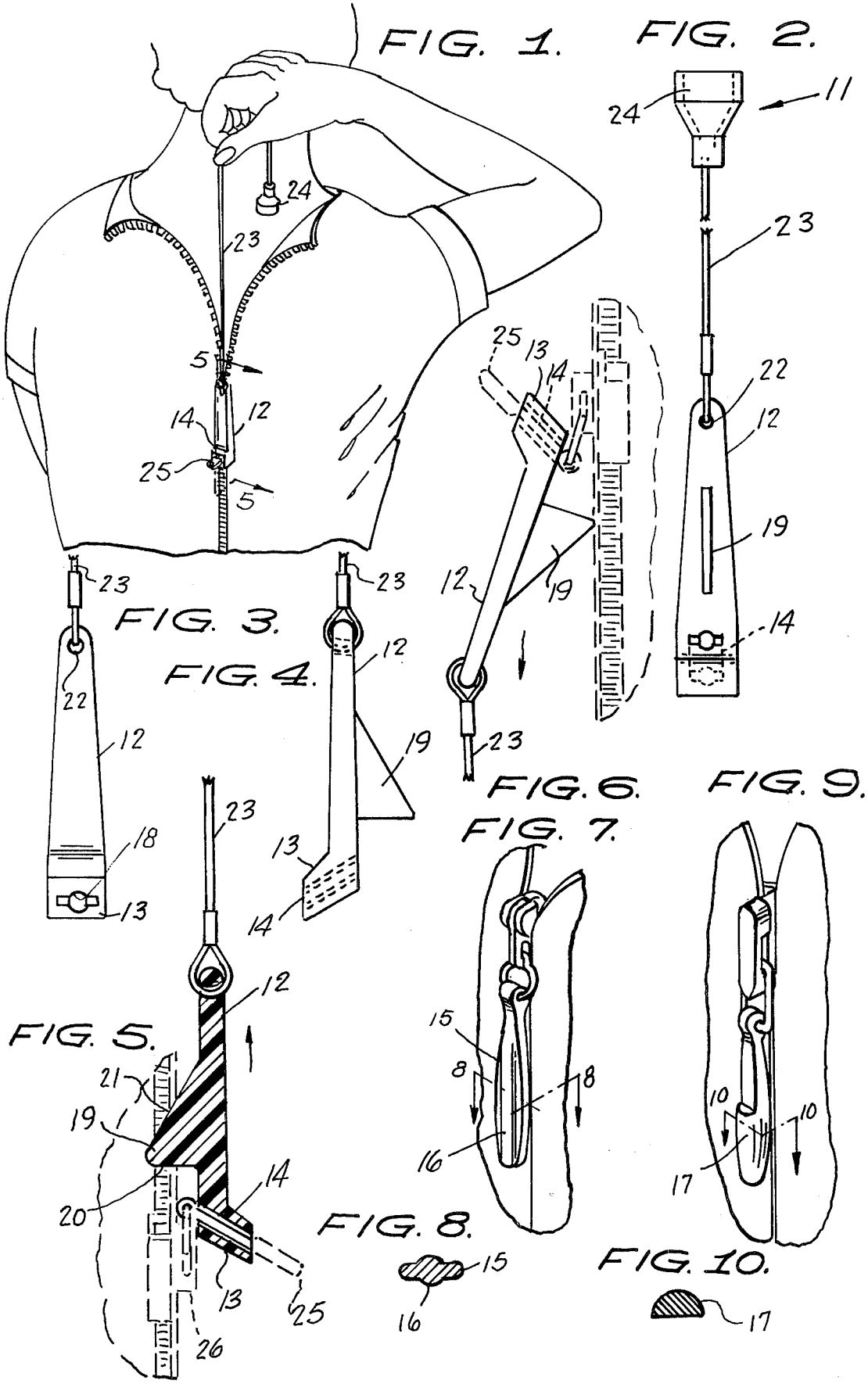
FIG. 1 is a fragmentary perspective view showing a person closing a rear garment zipper employing an improved zipper closure operating device according to the present invention.
FIG. 2 is an enlarged inside elevational view of the zipper closure operating device employed in FIG. 1.
FIG. 3 is an outside elevational view of the actuating member of the zipper operating device shown in FIGS. 1 and 2.
FIG. 4 is a side elevational view of the actuating member of the zipper operating device of FIGS. 1, 2 and 3.
FIG. 5 is an enlarged vertical cross-sectional view taken substantially on the line 5 — 5 of FIG. 1.
FIG. 6 is a side elevational view of the actuating member of the zipper operating device, shown in zipper-opening operating position.
FIG. 7 is a fragmentary perspective view of one form of conventional zipper with which the device of the present invention may be employed.
FIG. 8 is an enlarged horizontal cross-sectional view taken substantially on a line 8 — 8 of FIG. 7.
FIG. 9 is a fragmentary perspective view showing operating device of the present invention may be employed.
FIG. 10 is an enlarged horizontal cross-sectional view taken substantially on a line 10—10 of FIG. 9.

Referring to the drawings, 11 generally designates an improved zipper operating device constructed in accordance with the present invention. The device 11 comprises an actuating member 12 which flares downwardly in width and which is formed at its lower end with a downwardly and outwardly inclined integral lug 13 having a correspondingly downwardly and outwardly inclined slot 14. The slot 14 is preferably shaped to accommodate zipper tabs or irregular cross-sectional contour for example, a zipper tab 15 shown in FIGS. 7 and 8, having a thickened central longitudinal portion 16, or another form of conventional zipper tab 17 shown in FIGS. 9 and 10, which has a substantially half-round cross-sectional shape.

Thus, as shown in FIGS. 2 and 3, the inclined slot 14 may be formed with an enlarged longitudinally extending central cavity 18 to enable the slot to conformably receive zipper tabs of the type having enlarged longitudinal mid portions, such as that shown in FIGS. 7 and 8, or having a generally thickened mid portion with a cross-section of the type shown in FIGS. 9 and 10.

As shown in FIG. 5, the lug 13 is angled downwardly and outwardly. The body 12 is integrally formed with an inwardly directed, generally triangular guard lug or rib 19 of generally saw tooth shape having a horizontal bottom edge 20 and a downwardly and leftwardly inclined upper edge 21, as viewed in FIG. 5, adapted to engage between the teeth of a zipper and to act as a guard means to prevent the fabric of adjacent under garments or of the garment containing zipper from becoming enmeshed with the zipper teeth when the zipper is being closed by upward movement of the actuating member 12, as will be presently described.

The body of the actuating member 12 is formed at its top end with an aperture 22, and attached to the member 12 at said aperture is a flexible operating element which may comprise a cord 23 provided at its free end with a knob or handle 24 which may be easily grasped by the user.

In using the device 11, the user first engages the tab of the garment zipper to be closed, such as the tab 25 shown in FIG. 1, through the inclined slot 14 with the tab directed downwardly and outwardly therethrough in a manner illustrated in FIG. 5, and with the guard lug 19 arranged to extend between the zipper teeth. Thus, when the user pulls the cord 23 and exerts upward force thereon, the actuating member 12 is moved to a vertical position and the tab 25 becomes frictionally interlocked with the slot 14, whereby the operating member 12 is locked relative to tab 25 and whereby upward force exerted on the cord 23 will move the slide of the zipper, shown at 26 upwardly and close the zipper. Since the cord 23 is of substantial length, the user is not required to reach far behind her in order to operate the device, but is merely required to grasp the cord 23 or the knob 24 and exert upward force thereon. After the zipper is closed, the user may easily disengage the zipper tab 25 from the slot 14.

The zipper may be opened by following a reverse procedure with the actuating member 12 directed downwardly instead of upwardly, as shown in FIG. 6. Thus, in this condition, the zipper operating tab 25 is engaged in the slot 14 and is angled upwardly and outwardly and the lug 19 rides along the zipper when downward force is exerted on the pull cord 23. Again, the tab 25 is interlocked with the slot 14 in the inclined lug 13 and will be retained therein as the cord 23 is pulled downwardly to open the zipper.

It will be noted from FIG. 5 that the triangular fin or lug 19 is of sufficient size so that it will extend inwardly past the zipper teeth and will hold the adjacent fabric so as to prevent the fabric from becoming enmeshed with the teeth when the device is employed to close the zipper in the manner previously described and as illustrated in FIG. 1. As will be readily apparent, the guard fin or lug 19 may have other shapes than the specific shape illustrated in FIG. 5, it being merely necessary that it project inwardly sufficiently to hold the adjacent fabric away from the closing zipper teeth. The guard lug or fin is adapted to be positioned between the zipper elements or teeth in a manner such that as the zipper closure is worked to close the zipper, the fin or lug 19 acts as a separator to prevent the adjacent undergarment or the outer garment containing the zipper from catching between the zipper teeth elements.

It will be further apparent that the inclination of the slot 14 may be varied from that specifically illustrated in the drawings, the inclination from the horizontal of the slot 14, as viewed in FIG. 5, being approximately 30°, merely by way of example.

The actuating member 12 may be of any suitable material, preferably a material having substantial rigidity, although resilient materials may be also employed.

While a specific embodiment of a zipper closure operator for opening and closing zipper closures located at the backs of garments have been described in the foregoing description, it will be understood that various modifications within the spirit of the invention may occur to those skilled in the art. Therefore it is intended that no limitation be placed on the invention except as defined by the scope of the appended claims.

What is claimed is:

1. A zipper operating device for closing and opening a zipper having a sliding tab operator and disposed on the back of a wearer, comprising an elongated body member having flat, parallel, inner and outer sides and adapted to be pulled vertically upward to close the zipper with the inner side adjacent a wearer's body, a flexible cord attached to the upper end of the body member for pulling thereon to close a zipper, a slot at the lower end of the body member passing completely therethrough from the inner side at a downwardly and outwardly inclined angle, said slot being shaped to conformably and slidably receive and hold a zipper sliding tab, a guard rib projecting inwardly from said inner side above said slot and engageable with an undergarment of a zipper wearer between the teeth of the zipper when the body member is pulled upwardly along a zipper with the zipper tab engaged in said slot, said body member being adapted to be turned and pulled downwardly to open a zipper with the inner side again adjacent a wearer's body, the zipper tab being again engaged in and held in said slot but said guard rib engaging the closed zipper teeth and projecting a sufficient distance from the inner side to move the body member out of a vertical plane and cause said slot and tab to be inclined upwardly and outwardly to permit zipper opening with downward pull on the body member.

2. A zipper operating device for closing and opening a zipper according to claim 1, wherein said body member is provided with a projecting lug inclined downwardly and outwardly from the outer surface of the body member, said slot extending longitudinally through said lug.

3. The zipper operating device of claim 2, and wherein said guard rib comprises a rigid generally triangular fin element.

4. The zipper operating device of claim 3, and wherein said guard rib is generally of right triangular shape having a substantially horizontal bottom edge.

5. The zipper operating device of claim 1, and wherein the cross-section of said slot is enlarged at its intermediate portion relative to its side portions.

6. A zipper operating device according to claim 5, wherein said slot is of rectangular shape but enlarged in its center by a circular portion.

7. A zipper operating device according to claim 1, wherein the inclination of said slot is approximately 30° with respect to a horizontal when the body member is being lifted to close a zipper.

* * * * *